US005172447A

United States Patent [19]

Tomm

[11] Patent Number: 5,172,447

[45] Date of Patent: Dec. 22, 1992

[54] TAB LOCK ADAPTOR FOR BROOM HANDLES AND THE LIKE

[76] Inventor: Erwin Tomm, 3320 W. 130th St., Cleveland, Ohio 44111

[21] Appl. No.: 806,124

[22] Filed: Dec. 12, 1991

[51] Int. Cl.[5] ..... A46B 5/02

[52] U.S. Cl. ..... 15/159.1; 15/145; 16/114 R; 403/299; 403/342; 403/343

[58] Field of Search ..... 15/145, 176.2, 159 R; 403/299, 342, 343; 16/114 R

[56] References Cited

U.S. PATENT DOCUMENTS

| | | | |
|---|---|---|---|
| 1,229,843 | 6/1917 | Whitaker | 403/343 |
| 3,524,210 | 8/1970 | McLean | 403/343 |
| 4,541,139 | 9/1985 | Jones et al. | 15/145 |
| 4,642,837 | 2/1987 | Nichols et al. | 15/145 |

FOREIGN PATENT DOCUMENTS

| | | | |
|---|---|---|---|
| 252187 | 1/1988 | European Pat. Off. | 403/299 |
| 463527 | 7/1928 | Fed. Rep. of Germany | 403/343 |
| 1084871 | 1/1955 | France | 15/145 |
| 1530531 | 5/1968 | France | 15/145 |

*Primary Examiner*—Philip R. Coe

*Assistant Examiner*—Mark Spisich

*Attorney, Agent, or Firm*—Fay, Sharpe, Beall, Fagan, Minnich & McKee

[57] ABSTRACT

An improved broom assembly comprises a head member having an integrally threaded handle receiving opening with a handle threadedly connected therein and including a locking adaptor for preventing inadvertent unthreading of the handle from the head member. The locking adaptor comprises a generally cylindrical collet body member formed independently of the head member and the handle and having a central opening through which the handle slidably extends. The collet body member further includes resilient finger portions extending axially from the body member along the handle in a direction away from the head member. A nut member is threadedly received on the collet body member for movement axially thereof and includes a tapered surface engageable with the finger portions for driving the finger portions radially inward into gripping engagement with the handle. Engagement tabs extend axially between the collet body member and the head member for preventing relative rotation therebetween.

6 Claims, 2 Drawing Sheets

TAB LOCK ADAPTOR FOR BROOM HANDLES AND THE LIKE

BACKGROUND OF THE INVENTION

The subject invention is directed toward the art of brooms and brushes and, more particularly, to an improved arrangement for removably connecting a handle to such a device.

The invention is especially suited for connecting handles to cleaning implement such as sweeping brooms and scrubbing brushes and will be described with reference thereto; however, as will become apparent, the invention is capable of broader application and could be used in conjunction with a variety of similar handled implements.

The typical sweeping broom, push broom, scrubbing brush, as well as other similar devices, is often provided with a handle which is removably connected to the head with a coarsely threaded connection. Because of the coarse thread, it frequently results that twisting forces applied to the head during usage results in unthreading which causes the handle to become loose. Of course, this renders the device functionally ineffective and greatly reduces productivity.

In an effort to eliminate the loosening problem, the user frequently screws the handle into the head with great force. Generally, the handle must be screwed into the head until the head jambs itself on the end of the threaded handle stub. This results in large lateral forces being generated in the connecting threads. Sometimes the forces are sufficient to increase longitudinal splitting in the wooden broom and brush heads. And, often, the threads themselves are split, sheared, and otherwise damaged.

BRIEF STATEMENT OF THE INVENTION

The subject invention overcomes the above-discussed problems and provides a connector assembly which can be readily adapted to conventional threaded handles. Assemblies formed in accordance with the invention do not require the handle to be jam threaded onto the head.

In accordance with one aspect of the invention, there is provided a broom assembly which includes a head having an internally threaded handle receiving opening with a handle having a threaded end threadedly connected in the handle receiving opening. A locking adaptor means is provided for preventing inadvertent unthreading of the handle from the head. The adaptor means comprises a generally cylindrical collet body member formed independently of the head and the handle and having a central opening through which the handle extends. The collet body member further includes resilient finger portions which extend axially from the body member along the handle in a direction away from the head. Threadedly received on the body member is a nut which includes a tapered surface engaged with the finger portions for driving the finger portions radially inward into gripping engagement with the handle. Engagement means are provided to extend axially between the collet body member and the head for preventing relative rotation between the collet body member and the head.

Because of the radial gripping performed by the resilient finger members of the collet body member, the handle is firmly held by the fingers and unthreading does not take place when the head is subjected to the usual torque forces encountered during use of the broom.

In accordance with a more limited aspect of the invention, the engagement means comprise tab-like portions interlocked integrally with one of the body member and the broom head. The tab-like portions extend axially into engagement with the other of the two components.

Because the collet member is independent of the handle and the head, it can be more readily formed using normal injection molding techniques. Additionally, by forming the collet body member and the nut member as separate independent elements apart from the broom head and handle, the manufacturer can provide the same head and handle assembly either with or without the locking adaptor assembly. Thus, one type of broom and handle assembly can be produced and provided either with or without the locking adaptor. Preferably, all of the locking adaptor components are formed from plastics material using conventional injection molding techniques.

As can be seen from the foregoing, a primary object of the present invention is to provide a broom or the like device wherein the threadedly connected handle portion is associated with a locking assembly which prevents inadvertent uncoupling of the handle and head during usage of the broom.

A further object is the provision of a locking assembly of the general type described which is formed entirely independent of both the broom and the handle such that the broom can be sold either with or without the locking adaptor elements.

A further object of the invention is the provision of a locking adaptor assembly of the type described which is relatively simple in construction and which is easily connected or disconnected from the broom and handle combination.

BRIEF DESCRIPTION OF THE DRAWINGS

The above and other objects and advantages will become apparent from the following description when read in conjunction in the accompanying drawings wherein.

DETAILED DESCRIPTION OF THE PREFERRED EMBODIMENT

Figure 1:
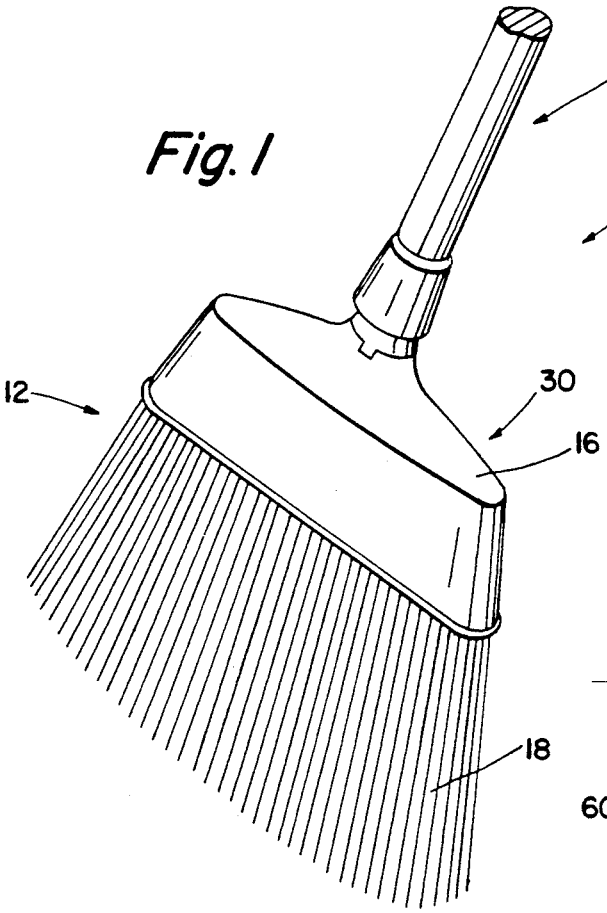
FIG. 1 is a pictorial view showing a broom and handle assembly having a locking adaptor assembly formed in accordance with the invention.

Referring more particularly to the drawings wherein the showings are for the purpose of illustrating a preferred embodiment of the invention only and not for the purpose of limiting same, FIG. 1 shows the overall arrangement of a typical broom assembly 10 which includes a broom head 12 and a handle 14 connected thereto. As used in the subject specification and claims, the general term "broom" and "broom head" are intended to include a variety of mop, brush, and broom-like elements which are manually manipulated by a handle joined thereto.

Figure 3:
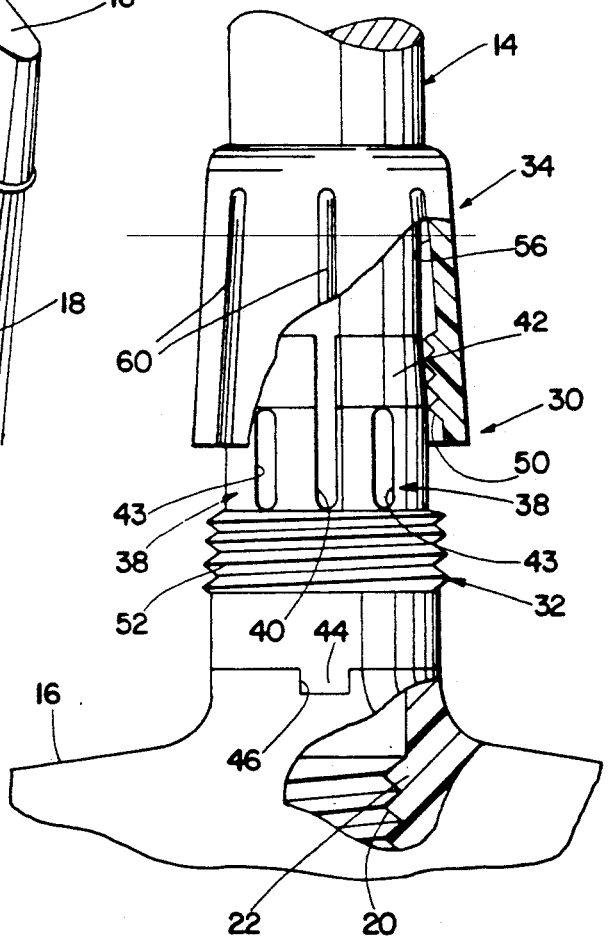
FIG. 3 is a view similar to FIG. 2 but showing the locking adaptor in the discomected position (portions have been broken away to more clearly show the internal structural of various components)

Referring again to FIG. 1, the broom head 12 includes a main head element 16 which carries the bristles or brush elements 18 extending therefrom. The head 16 is formed from any suitable material such as wood or plastics and preferably has the handle member 14 connected thereto through the use of interconnecting threads best shown in FIG. 3. Referring in particular to FIG. 3, it will be seen that the lower end of the handle 14 is threaded as shown at 20 and is threadedly engaged in a correspondingly threaded opening 22 formed inwardly of the broom head element 16 and interconnected by relatively coarse threads as is the usual case. The threads on the broom are normally directly formed therein. However, it is known to provide separate threaded elements to which the handle is permanently or removably attached.

Figure 2:
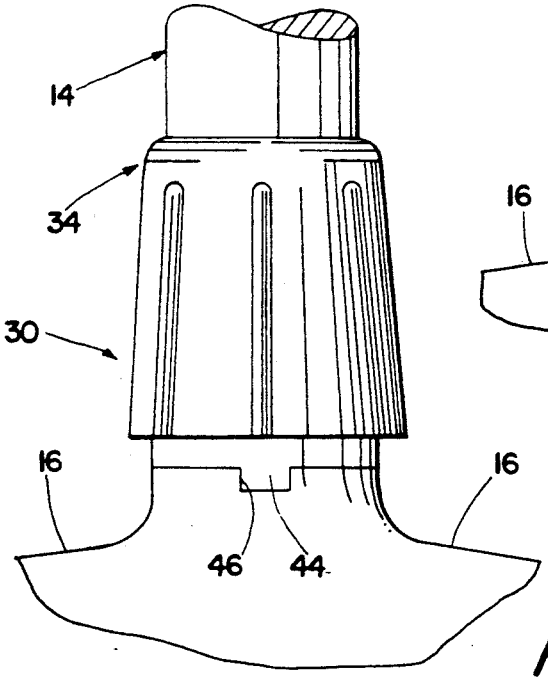
FIG. 2 is an enlarged side view of the adaptor assembly in position on the interconnected broom and handle.
Figure 4:
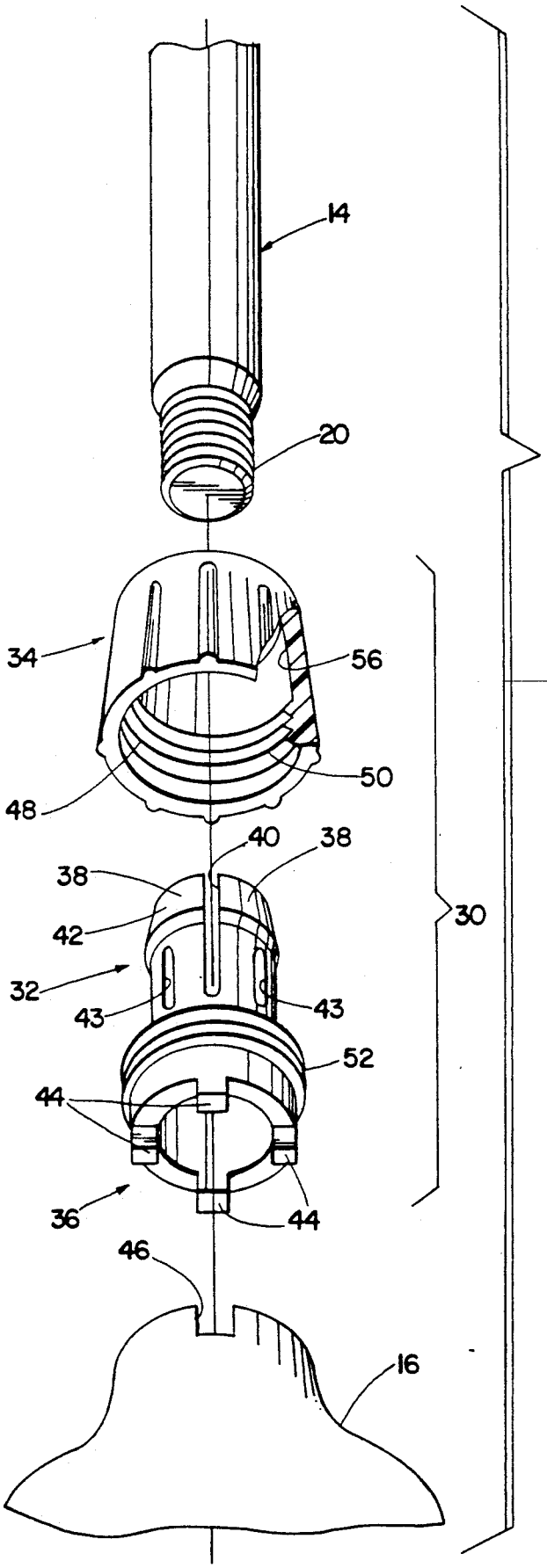
FIG. 4 is a pictorial view showing the locking adaptor elements in a separated and disconnected condition; and, FIG. 5 is a longitudinal cross-section through the collet body element.

As was discussed earlier, it sometimes happens that during use of the conventional broom-handle combination, the loads applied to the broom head during usage create torques which tend to loosen the threaded connection between the head and the handle. In order to overcome this, the user often over-tightens or is forced to continually retighten the handle head combination. In accordance with the subject invention, this problem is overcome by the addition of a locking adaptor assembly indicated generally with the numeral 30. The assembly 30 comprises two separate elements which are formed independently of both the broom head element 16 and the handle 14. As best shown in FIGS. 2 through 4, the locking adaptor assembly generally includes a first element in the form of an elongated, somewhat cylindrical, collet body member 32 and an associated nut member 34. The collet body member has a central axially extending opening 36 which is sized so as to closely, but slidably receive the handle 14 allowing it to extend freely therethrough as illustrated in FIG. 3. A plurality of resilient fingers 38 extend axially from one end of the collet body 32 such that when the collet body is in position on the handle 14 as illustrated in FIG. 4, the fingers 38 extend axially of the handle along the exterior thereof pointing in a direction away from the broom head element 16. The actual number of resilient fingers provided could, of course, vary widely; however, in the subject embodiment, there are four of the fingers 38 separated from one another by axially extending slots 40 which extend completely through the exterior of the collet body 32 into the central opening 36. The fingers 38 are radially resilient and have a tapered end as seen in FIGS. 3 and 4. This tapered end is generally indicated with the reference numeral 42. To increase the flexibility of the fingers 38, they are provided with vertically extending oval slots or openings 43. The openings 43 extend completely through fingers 38.

At the inner surface of the upper ends of the resilient fingers 28, there are inclined surfaces 39 which act to provide somewhat of a bell mouth to the handle receiving open end. This has the advantage of facilitating handle insertion especially after the assembly has been in use and the fingers 38 have taken a slight radial inward set as may sometimes happen with the locking of the nut around a smaller handle.

At its lower end, the collet body member 32 is provided with axially extending protrusions in the form of four tab-like members 44. The tab-like members 44 are preferably integrally formed on the body and are adapted to enter into and engage with four correspondingly shaped and positioned slot members 46 formed adjacent the entry end to the threaded opening 22 in the broom head element 16. The cooperation between the tab-like members 44 and the cross slots 46 prevents relative rotation between the collet body member 32 and the broom head 16 when the locking adaptor assembly is in the connected and assembled position shown in FIG. 2.

The previously-mentioned nut member 34 is also preferably molded from plastics material and has a central opening 48 which extends axially therethrough and is sized so as to be received on the exterior of the collet member 32. Threads 50 are formed internally of the opening 48 adjacent the lower end of the nut member and are arranged for cooperation with correspondingly sized threads 52 formed externally about the lower end of the collet body 32. At the upper end of the through opening 48, there is a conically tapered surface 56 which extends circumferentially about the opening 48. The surface 56 is preferably at an angle of incline corresponding to the surface 42 on the collet body member 32. Thus, when the nut member 34 is tightened on the collet body 32 to the position illustrated in FIG. 2, the cooperation between the inclined surfaces 56 and 42 drives the resilient fingers 38 radially inward into gripping engagement with the external surface of the handle member 14. To allow firm tightening and manual manipulation of the nut member 34, the exterior of the nut is preferably provided with longitudinally extending ribs or the like 60 which increase the ability of the user to grip and rotate the nut member 34. The tightening of the nut member to an assembled position, such as shown in FIG. 2, does, as previously mentioned, cause the resilient fingers 38 to be moved radially inward to firmly grip the handle 14. This gripping results in the handle being gripped in a manner which prevents it from being rotated to a loosened position by normal torque forces encountered during use of the broom assembly. It is, however, possible to manually release the nut member 34 so that the handle 14 can be removed from the broom head 16 by a simple unthreading operation.

Figure 5:
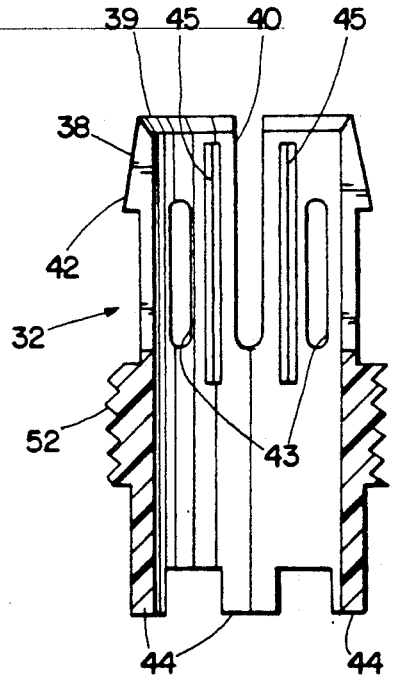

The ability of the fingers 38 to grip the exterior surface of handles inserted in the opening is further enhanced by vertically extending ribs or teeth 45 (see FIG. 5) formed about the interior surfaces of the fingers. Preferably, the tips of the teeth 45 are relatively sharp to increase the engagement forces.

The design of the collet assembly and the resilient fingers are such that the assembly is capable of tightly gripping handles of significantly different diameters. For example, handles varying by as much as $\frac{1}{8}''$ and more in diameter can be tightly gripped and held against undesired rotation.

Because the collet body member is formed independent of the broom head element 16, the broom head and handle assembly can be used and sold without the locking adaptor assembly included therewith.

In addition to providing a locking function to prevent inadvertent untwisting of the handle from the broom head assembly, the locking adaptor further strengthens the connection between the handle and the head assembly so that forces on the handle are shifted to a portion of the handle which has greater strength than the threaded lower end. That is, lateral forces which are encountered in a normal threaded broom are shifted away from the thread joint to a point wherein the handle enters the locking adaptor assembly. As a result, the broom of the subject invention is stronger in the joint connection than a typical broom without the adaptor assembly.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having described the invention, it is claimed:

1. A broom assembly comprising:

a broom head having an internally threaded handle receiving opening formed therein;

a handle having a threaded end threadedly connected in said handle receiving opening; and, a locking adaptor means for preventing inadvertent unthreading of said handle from said head, said adaptor means comprising; a generally cylindrical collet body member formed independently of said head and said handle extends, said collet body member being axially slidable on said handle toward and away from said head and further including resilient finger portions extending axially from said body member along said handle in a direction away from said head, a nut member threadedly received on said collet body member for movement axially thereof and including a tapered surface engageable with said finger portions for driving said finger portions radially inward into gripping engagement with said handle, and engagement means extending axially between said collet body member and said head for preventing relative rotation between said collet body member and said head while permitting free axial sliding movement toward and away from said head when said nut member is unthreaded from said collet body member.

2. A broom assembly as defined in claim 1 wherein said engagement means comprise an axially extending tab-like integral extension on said collet body member and engaged with a slot formed in said head.

3. A broom assembly as defined in claim 1 wherein said collet body member and said nut member are formed of plastics material.

4. A broom assembly as defined in claim 1 wherein said nut member includes internal threads which engage with external threads formed on said collet body member.

5. A broom assembly as defined in claim 1 where said engagement means includes a plurality of axially extending tab-like members formed on one of said collet body and said head and engaged with slots formed in the other of said collet body and said head.

6. The broom assembly as defined in claim 1 wherein said engagement means include formations formed integrally on said collet body directly engageably with complementary formations formed integrally on said head.

* * * * *